US010017194B1

(12) United States Patent
Jackson

(10) Patent No.: US 10,017,194 B1
(45) Date of Patent: Jul. 10, 2018

(54) RAILCAR UNCOUPLING LEVER SYSTEM AND METHOD OF USE

(71) Applicant: John Jackson, Texarkana, AR (US)

(72) Inventor: John Jackson, Texarkana, AR (US)

( * ) Notice: Subject to any disclaimer, the term of this patent is extended or adjusted under 35 U.S.C. 154(b) by 315 days.

(21) Appl. No.: 14/935,696

(22) Filed: Nov. 9, 2015

Related U.S. Application Data

(60) Provisional application No. 62/244,838, filed on Oct. 22, 2015.

(51) Int. Cl.
*B61G 7/02* (2006.01)

(52) U.S. Cl.
CPC ..... *B61G 7/02* (2013.01)

(58) Field of Classification Search
CPC ... B61G 3/08; B61G 7/02; B61G 1/04; B61G 3/14; B61G 3/26
See application file for complete search history.

(56) References Cited

U.S. PATENT DOCUMENTS 5,207,436 A * 5/1993 Lederman ..... F16C 33/7879 277/353
6,739,464 B1 * 5/2004 Manyek ..... B61G 3/08 213/159
7,686,177 B1 * 3/2010 Jackson ..... B61G 7/02 213/159
2010/0065385 A1 * 3/2010 Teper ..... F16D 55/22655 188/73.45

* cited by examiner

*Primary Examiner* — Mark T Le
(74) *Attorney, Agent, or Firm* — Richard Eldredge

(57) ABSTRACT

A railcar lever system for decoupling a first railcar from a second railcar, the system includes a first elongated lever having a working element to engage with a lock lifter at a first end and a stop at an opposing second end; a second elongated lever having a handle at a first end and a stop at an opposing second end; a middle elongated lever configured to slidingly engage with both the first elongated lever and the second elongated lever; a first bracket rigidly secured to a first surface of the middle elongated lever, the first bracket being configured to slidingly receive the first elongated lever; a second bracket rigidly secured to a second surface of the middle elongated, the second bracket being configured to slidingly receive the second elongated lever; a first guide pad removeably attached to the first bracket, the first guide being disposed between an inner surface of the first bracket and an outer surface of the first elongated lever; and a second guide pad removeably attached to the second bracket, the second guide being disposed between an inner surface of the second bracket and an outer surface of the second elongated lever.

5 Claims, 6 Drawing Sheets

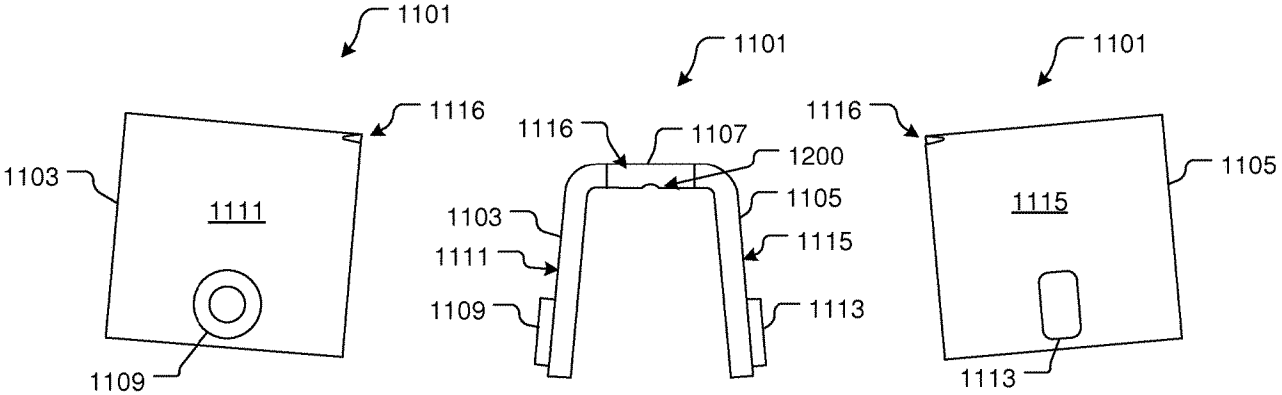
FIG. 11
FIG. 12
FIG. 13
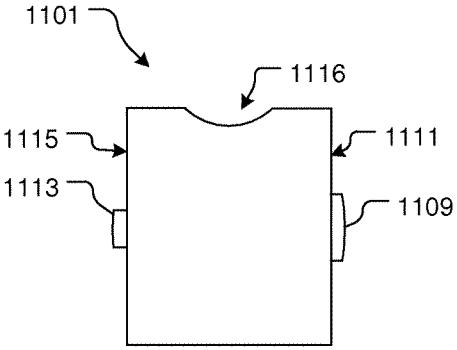
FIG. 14

RAILCAR UNCOUPLING LEVER SYSTEM AND METHOD OF USE

BACKGROUND

1. Field of the Invention

The present invention relates generally to decoupling systems for railcars.

2. Description of Related Art

Uncoupling lever assemblies connected to railcars must be able to rotate the lock lifter of a coupler and also be able to change their length to accommodate movement of the coupler relative to the railcar during travel. Uncoupling levers are typically connected to the railcar with a pivotal connection on the handle, and the opposite end is connected to the lock lifter on the coupler. Rotating the handle causes the lever assembly to rotate and also rotates the lock lifter. Rotating the lock lifter causes the coupler to release so that adjacent cars may be uncoupled. The coupler will move laterally relative to the railcar when the railcar negotiates turns. Couplers may also extend or retract upon impact with other railcars. As the coupler moves relative to the railcar, the distance between the coupler and the mounting location of the handle changes, therefore, the length of the lever assembly must change.

It is important that the levers of the lever assembly remain freely movable relative to each other without binding. When the coupler moves, it does so with great force. Any binding in the lever assembly prevents it from changing its length, which could result in damage to the railcar, damage to the coupler, and/or damage to the lever assembly. Several attempts to produce levers that change their length without binding have been made. Plastic glides have been used that go into enclosures that levers slide through so that individual levers may slide relative to each other without metal-to-metal contact that will likely cause binding. Over time, plastic glides can be degraded by ultraviolet (UV) light. If glides become brittle due to UV light exposure, they may become cracked, fall out of the enclosures, and allow metal-to-metal contact between the levers and enclosures. Glides in the prior art generally depend on external protrusions to retain them in their enclosures. Failure of the external protrusions from UV light degradation will cause the glides to dislodge from their enclosures and allow metal-to-metal contact between the levers and enclosures.

Although great strides have been made in the area of systems and methods to decouple railcars, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIG. 11 is a left side view of a guide pad in accordance with an alternative embodiment of the present application;

FIG. 12 is a front view of the guide pad of FIG. 11;

FIG. 13 is a right side view of the guide pad of FIG. 11;

FIG. 14 is a top view of the guide pad of FIG. 11;

Figure 1:
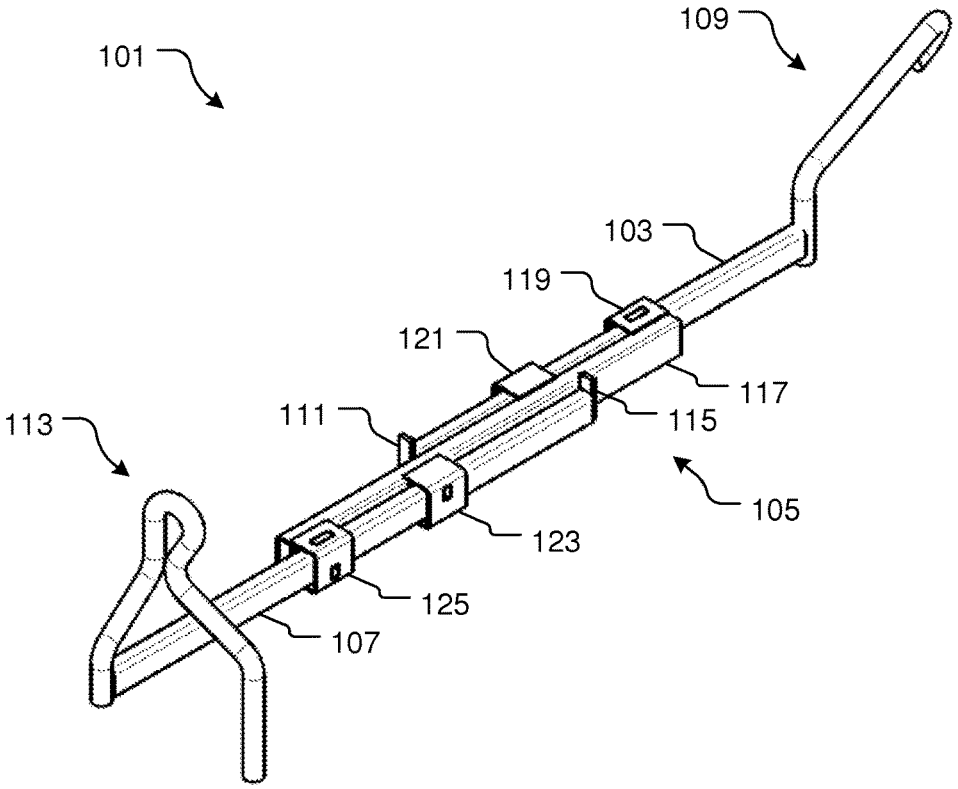
FIG. 1 is an oblique view of a decoupling system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a decoupling system 101 in accordance with a preferred embodiment of the present application. It will be appreciated that system 101 overcomes one or more of the above-listed problems commonly associated with the conventional decoupling systems discussed above.

System 101 includes a first elongated lever 103, a middle elongated lever 105, and a second elongated lever 107 that slidingly engage with each other for selective adjustment of the overall length of system 101.

First lever 103 includes a working element 109 configured to engage with a lock lifter associated with the railcar and a stop 111 configured to engage with a bracket 121. Likewise, second lever 107 includes a handle 113 configured to be manipulated by the worker and a stop 115 configured to engage with a bracket 123.

Figure 2:
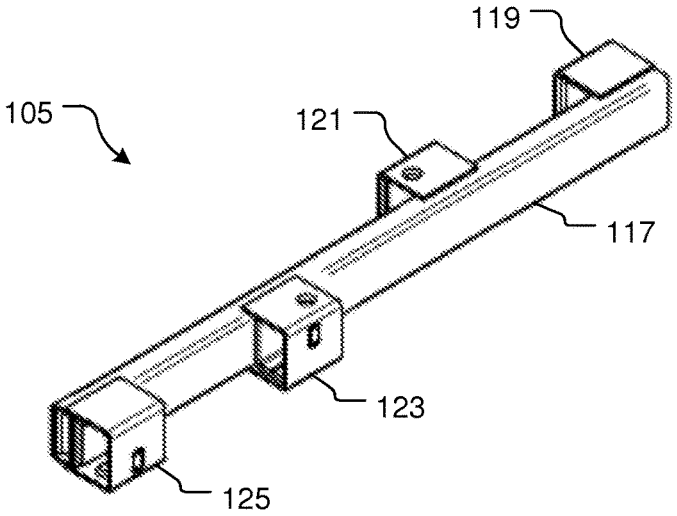
FIG. 2 is an oblique view of a middle lever of the decoupling system of FIG. 1.

Middle lever 105 includes an elongated body 117 with four brackets rigidly attached thereto and extending a distance therefrom, as depicted in FIGS. 1 and 2. In the contemplated embodiment, two brackets 119, 121 extend at opposing ends from brackets 123, 125. During use, the brackets are used to enable the first and second levers to slidingly engage with the middle lever. As discussed above, guide pads are used to allow the sliding engagement between the levers and brackets. These features are discussed more fully below and shown in the accompanying drawings.

Figure 3:
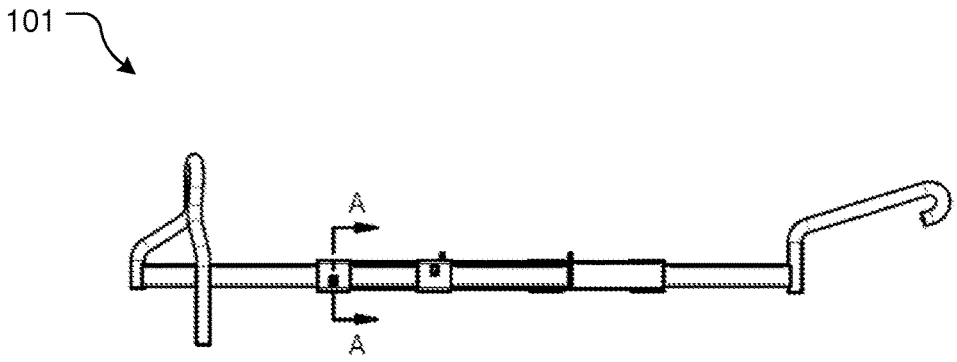
FIG. 3 is a front view of the decoupling system of FIG. 1.
Figure 4:
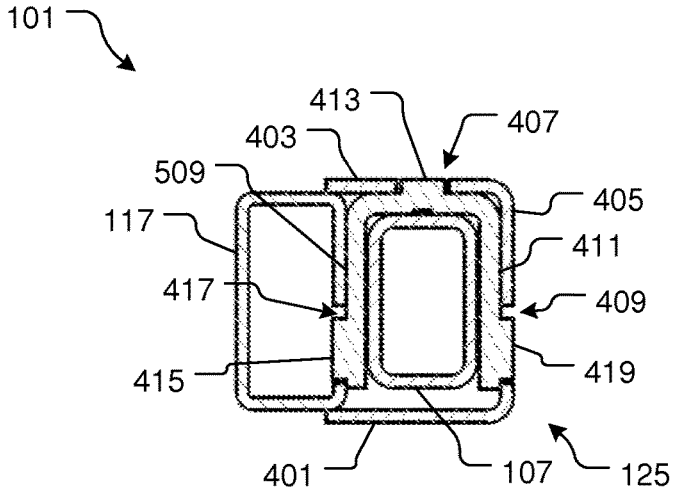
FIG. 4 is a cross-sectional view of the decoupling system of FIG. 1 taken at A-A.

Referring now specifically to FIGS. 3 and 4, further detailed illustration of the brackets and guide pads are shown. In the preferred embodiment, bracket 125 is configured to removably retain a guide pad 411 in a fixed position. To achieve this feature, bracket 125 includes two opposing sides, first side 401 and second side 403, joined together and integral with a third side 405, wherein the three sides form a "U-shaped" configuration. In the exemplary embodiment, side 403 includes an opening 407, while third side 405 includes an opening 409 configured to receive and secure respective protrusions 413, 419 protruding from the body of guide 411. In the exemplary embodiment, the middle lever 117 forms an opening 417 configured to engage with a protrusion 415.

As will be shown in the following drawings and description, alternative embodiments of the guide and bracket are contemplated.

Figure 5:
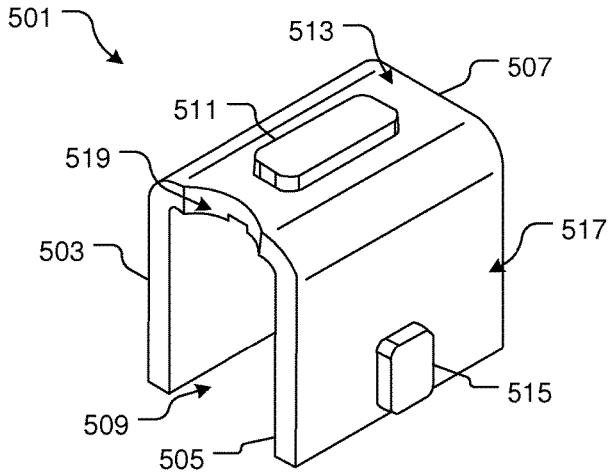
FIG. 5 is an oblique view of a guide pad of the decoupling system of FIG. 1.
Figure 6:
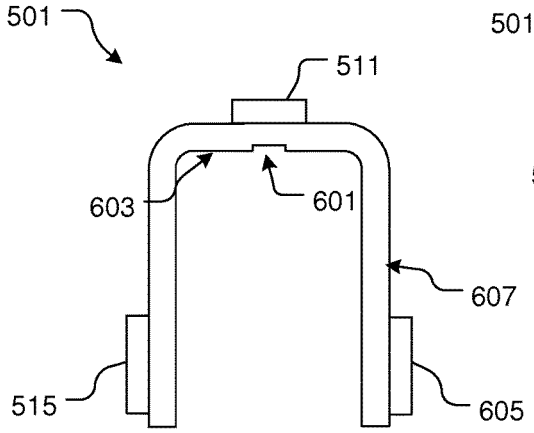
FIG. 6 is a front view of the guide pad of FIG. 5.
Figure 7:
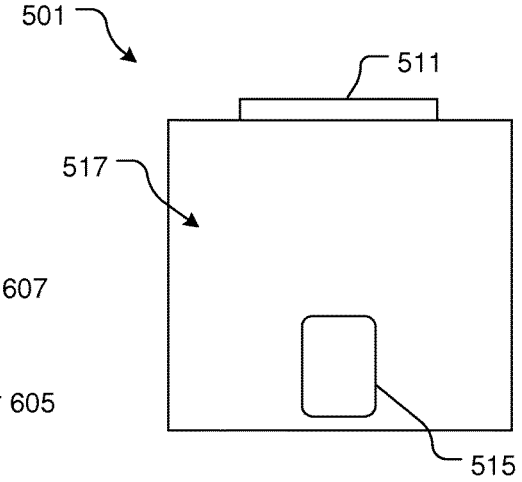
FIG. 7 is a side view of the guide pad of FIG. 5.

Referring now to FIGS. 5-7, an alternative guide pad 501 is shown. It will be appreciated that guide pad 501 is substantially similar in form and function to guide pad 411 and incorporates the features discussed herein.

Guide pad 501 includes a first side 503, second side 505, and a third side 507 that form a U-shaped configuration with an opening 509 adapted to allow the lever to slide therein during use. Like guide pad 411, it is contemplated having protrusions 511, 515, and 605 extend from respective outer surfaces 513, 517, and 607. As discussed above, the protrusions are configured to engage with the openings of the bracket, which in turn retain the guide pad in a fixed position.

Guide pad 501 is further provided with a circular indentation 519 on side 507 and one or more debris channels 601 extending within inner surface 603 of side 507. During use, the debris channels are utilized to allow the debris materials, e.g., metal, dirt, grease, and the like to travel therethrough as the levers slide relative to each other.

One of the unique features believed characteristic of the present application is the use of a dry lubricant added to the guide pad material. This feature is achieved during the manufacturing process, wherein the dry lubricant is added prior to the forming and/or extrusion process. It will be appreciated that the dry lubricant provides significant advantages, namely, the material increases lifespan of the guide pad in addition to reducing the friction contact. Such features reduces the overall costs with continued maintenance and replacement.

In the preferred embodiment, the dry lubricant could comprise of one or more of a molybdenum disulfide, graphite, Teflon, and/or other similarly suitable material sharing the same characteristics. During manufacturing, the dry lubricant is added to the plastic material of the pad, mixed, and then later protruded and/or formed to create the desired pad shape and dimension.

Referring now to FIGS. 8-14, alternative embodiments of the guide pads are illustrated. It will be appreciated that the different embodiments of the guide pads, although not shown, may share the same features.

Figure 8:
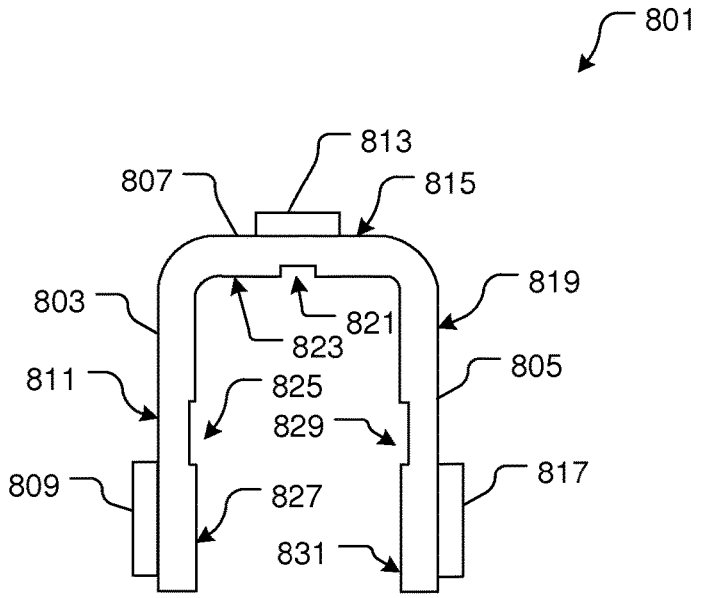
FIG. 8 is a front view of a guide pad in accordance with an alternative embodiment of the present application.

In FIG. 8, guide pad 801 includes a first side 803, a second side 805, and a third side 807. Protrusions 809, 813, and 817 extend from respective surfaces 811, 815, and 819 of respective sides 803, 807, and 805.

In the contemplated embodiment, guide pad 801 is further provided with three debris channels 821, 825, and 829 extending partially within the respective inner surfaces 823, 827, and 831 of respective sides 807, 803, and 805.

Figure 9:
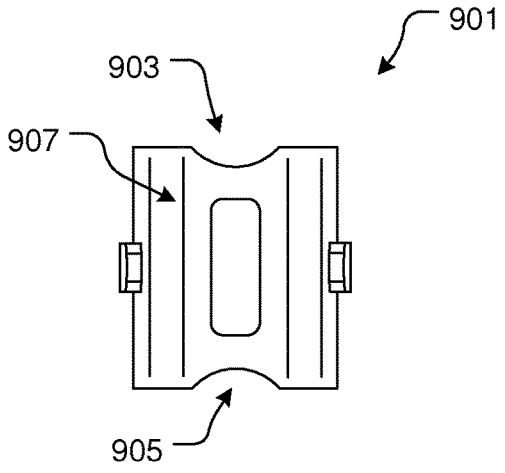
FIG. 9 is a top view of the guide pad of FIG. 8.
Figure 10:
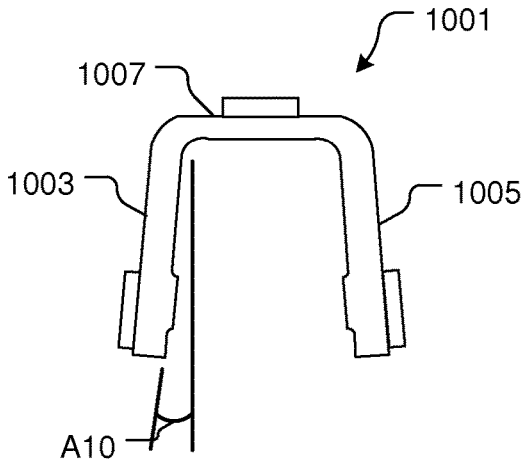
FIG. 10 is a front view of a guide pad in accordance with an alternative embodiment of the present application.

In FIG. 9, a guide pad 901 includes two opposing indentations 903, 905 on opposing ends of side 907, while in FIG. 10, the guide pad 1001 includes two sides 1003, 1005 oriented at an angle A10 relative to the third side 1007. This feature allows the guide pad to be spring-loaded for a snug fit.

In FIGS. 11-14, guide pad 1101 includes a first side 1103, a second side 1105, and a third side 1107. Protrusions 1109 and 1113 extend from respective surfaces 1111 and 1115 of respective sides 1103 and 1105. The guide pad is further provided with an indentation 1116 on surface 1117 and a debris channel 1200.

In the contemplated embodiment, it will be appreciated that the shape and design of the protrusions could be different, as clearly depicted in the exemplary embodiment.

Figure 15:
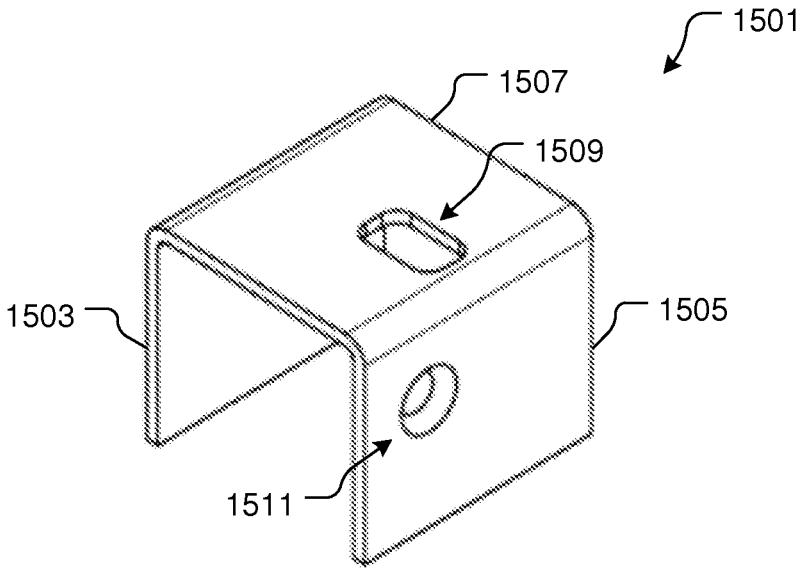
FIG. 15 is an oblique view of a bracket in accordance with an alternative embodiment of the present application.
Figure 16:
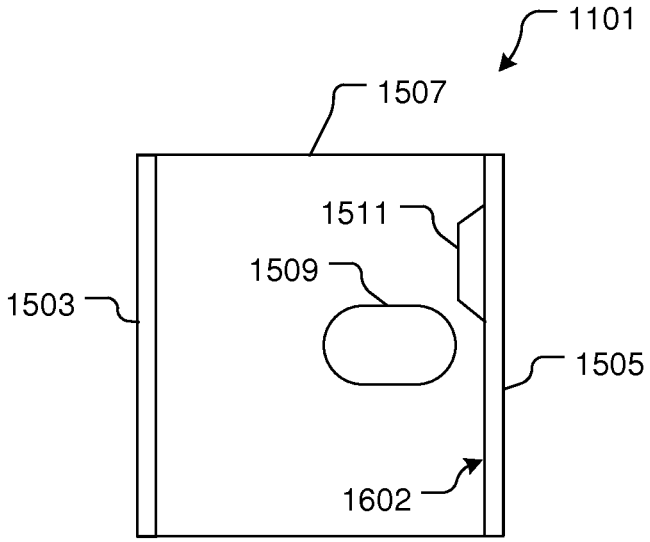
FIG. 16 is a bottom view of the bracket of FIG. 15.

In FIGS. 15 and 16 an alternative embodiment of a bracket is shown. In the exemplary embodiment, bracket 1501 includes a first side 1503, second side 1505, and third side 1507. An elongated rectangular opening 1509 extends through the surface of side 1507, while a circular indentation 1511 extends through side 1505. As shown specifically in FIG. 16, the indentation 1511 could protrude within the cavity formed by the bracket about surface 1602.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A railcar lever system for decoupling a first railcar from a second railcar, the system comprising:

a first elongated lever having a working element to engage with a lock lifter at a first end and a stop at an opposing second end;

a second elongated lever having a handle at a first end and a stop at an opposing second end;

a middle elongated lever configured to slidingly engage with both the first elongated lever and the second elongated lever;

a first bracket rigidly secured to a first surface of the middle elongated lever, the first bracket being configured to slidingly receive the first elongated lever;

a second bracket rigidly secured to a second surface of the middle elongated, the second bracket being configured to slidingly receive the second elongated lever;

a first guide pad removeably attached to the first bracket, the first guide pad being disposed between an inner surface of the first bracket and an outer surface of the first elongated lever, the first guide pad having:

a body with a first side, a second side extending relatively parallel to the first side, and a third side integrally joined to the first side and the second side, the body forming a U-shaped configuration;

a debris indentation extending inwardly into the third side, the debris indentation is configured to collect debris during the sliding motion of the first lever relative to the first bracket;

a channel extending inwardly into the debris indentation and extending a longitudinal length of the body;

a first protrusion extending from a first outer surface of the third side, the first protrusion is configured to engage with a first opening of the first bracket; and a second protrusion extending from a second outer surface of the second side, the second protrusion is configured to engage with a second opening of the first bracket; and a second guide pad removeably attached to the second bracket, the second guide pad being disposed between an inner surface of the second bracket and an outer surface of the second elongated lever;

wherein friction is created between the first guide pad and the first elongated lever to retain the first elongated lever in a stationary position; and wherein friction is created between the second guide pad and the second elongated lever to retain the second elongated lever in a stationary position.

2. The system of claim 1, the first guide pad further comprising:

a second debris channel extending a length of the first side;

wherein the second debris channel is configured to allow passage of debris during the sliding motion of the first lever relative to the first bracket.

3. The system of claim 1, the first guide pad comprising:

the first protrusion being a first circular protrusion extending from the first side; and the second protrusion being a rectangular protrusion extending from the second side.

4. A method to decouple a first railcar relative to a second railcar, the method comprising:

providing the system of claim 1;

sliding the first elongated lever and the second elongated lever relative to the middle elongated lever to obtain a desired length;

securing the working element to the lifter; and manipulating the handle.

5. The method of claim 4, further comprising:

adding a dry lubricant within the first guide pad as an addition to a guide material.

* * * * *